US006122611A

United States Patent [19]

Su et al.

[11] Patent Number: 6,122,611

[45] Date of Patent: Sep. 19, 2000

[54] ADDING NOISE DURING LPC CODED VOICE ACTIVITY PERIODS TO IMPROVE THE QUALITY OF CODED SPEECH COEXISTING WITH BACKGROUND NOISE

[75] Inventors: Huan-yu Su, San Clemente; Adil Benyassine, Irvine, both of Calif.

[73] Assignee: Conexant Systems, Inc., Newport Beach, Calif.

[21] Appl. No.: 09/075,365

[22] Filed: May 11, 1998

[51] Int. Cl.[7] ..... G10L 19/14

[52] U.S. Cl. ..... 704/228; 704/219; 704/233

[58] Field of Search ..... 704/219, 226, 704/227, 228, 233

[56] References Cited

U.S. PATENT DOCUMENTS

| | | | |
|---|---|---|---|
| 5,142,582 | 8/1992 | Asakawa et al. | 704/228 |
| 5,327,457 | 7/1994 | Leopold | 375/228 |
| 5,812,965 | 9/1998 | Massaloux | 704/205 |
| 5,864,799 | 1/1999 | Corretjer et al. | 704/228 |
| 6,055,497 | 4/2000 | Hallkvist et al. | 704/228 |

FOREIGN PATENT DOCUMENTS

| | | | |
|---|---|---|---|
| 0 786 760 A2 | 7/1997 | European Pat. Off. | G10L 3/00 |

OTHER PUBLICATIONS

Cyrille Morel, "Comfort noise generation device for speech encoding–decoding", Derwent abstract 1998–508727 of published foreign patent publications, Dec. 1998.

*Primary Examiner*—David R. Hudspeth
*Assistant Examiner*—Tālivaldis Ivars Šmits
*Attorney, Agent, or Firm*—Price, Gess & Ubell

[57] ABSTRACT

A system and method to improve the quality of coded speech coexisting with background noise. For instance, the present invention receives a coded speech signal via a communication network and then decodes and synthesizes the different parameters contained within it to produce a synthesized speech signal. The present invention determines the non-speech periods that are represented within the synthesized speech signal. The determined non-speech periods are then utilized to determine and code LPC parameters needed for background noise synthesis. Because medium or low bit rate LPC-coded speech during voice activity periods has the coexisting background noise attenuated, the decoded signal has audible abrupt changes in the level of the background noise. To improve decoded speech quality, the present invention adds simulated background noise to decoded noisy speech when synthesizing the noisy speech signal during voice activity periods. The resulting output signal sounds more natural and realistic to the human ear because of the continuous presence of background noise during speech and non-speech periods.

19 Claims, 8 Drawing Sheets

ADDING NOISE DURING LPC CODED VOICE ACTIVITY PERIODS TO IMPROVE THE QUALITY OF CODED SPEECH COEXISTING WITH BACKGROUND NOISE

TECHNICAL FIELD

The present invention relates to the field of communication. More specifically, the present invention relates to the field of coded speech communication.

BACKGROUND ART

During a conversation between two or more people, ambient or background noise is typically inherent to the overall listening experience of the human ear. FIG. 1 illustrates the analog sound waves 100 of a typical recorded conversation that includes background or ambient noise signals 102 along with speech groups 104–108 caused by voice communication. Within the technical field of transmitting, receiving and storing speech communication, several different techniques exist for coding and decoding speech groups 104–108. One of the techniques for coding and decoding speech groups 104–108 is to use an analysis-by-synthesis coding system such as code excited linear predictive (CELP) coders, see for example the International Telecommunication Union (ITU) Recommendation G.729.

FIG. 2 illustrates a general overview block diagram of a prior art analysis-by-synthesis system 200 for coding and decoding speech. An analysis-by-synthesis system 200 for coding and decoding speech groups 104–108 of FIG. 1 utilizes an analysis unit 204 along with a corresponding synthesis unit 220. Analysis unit 204 represents an analysis-by-synthesis type of speech coder, such as a CELP coder. A code excited linear prediction coder is one way of coding speech groups 104–108 at a medium or low bit rate in order to meet the constraints of communication networks and storage capacities.

In order to code speech, the microphone 206 of FIG. 2 of the analysis unit 204 receives the analog sound waves 100 of FIG. 1 as an input signal. The microphone 206 outputs the received analog sound waves 100 to the analog to digital (A/D) sampler circuit 208. The analog to digital sampler 208 converts the analog sound waves 100 into a sampled digital speech signal (sampled over discrete time periods) which is output to the linear prediction coefficients (LPC) extractor 210 and the code book 214.

The linear prediction coefficients extractor 210 of FIG. 2 extracts the linear prediction coefficients from the sampled digital speech signal it receives from the A/D sampler 208. The linear prediction coefficients, which are related to the short term correlation between adjacent speech samples, represent the vocal tract of the sampled digital speech signal. The determined linear prediction coefficients are then quantized by the LPC extractor 210 using a look up table with an index, as described above. The LPC extractor 210 then transmits the remainder of the sampled digital speech signal to the pitch extractor 212, along with the index values of the quantized linear prediction coefficients.

The pitch extractor 212 of FIG. 2 removes the long term correlation that exists between pitch periods within the sampled digital speech signal it receives from the linear prediction coefficients extractor 210. In other words, the pitch extractor 212 removes the periodicity from the received sampled digital speech signal resulting in a white residual speech signal. The determined pitch value is then quantized by the pitch extractor 212 using a look up table with an index, as described above. The pitch extractor 212 then transmits the index values of the quantized pitch and the quantized linear prediction coefficients to the storage/transmitter unit 216.

The code book 214 of FIG. 2 contains a specific number of stored digital patterns, which are referred to as code words. The code book 214 is normally searched in order to provide the best representative vector to quantize the residual signal in some perceptual fashion as known to those skilled in the art. The selected code word or vector is typically called the fixed excitation code word. After determining the best code word that represents the received signal, the code book circuit 214 also computes the gain factor of the received signal. The determined gain factor is then quantized by the code book 214 using a look up table with an index, which is a well known quantization scheme to those of ordinary skill in the art. The code book 214 then transmits the index of the determined code word along with the index value of the quantized gain to the storage/transmitter unit 216.

The storage/transmitter 216 of FIG. 2 of the analysis unit 204 then transmits to the synthesis unit 220, via the communication network 218, the index values of the pitch, gain, linear prediction coefficients, and the code word which all represent the received analog sound waves signal 100. The synthesis unit 220 decodes the different parameters that it receives from the storage/transmitter 216 to obtain a synthesized speech signal. To enable people to hear the synthesized speech signal, the synthesis unit 220 outputs the synthesized speech signal to speaker 222.

There is a disadvantage associated with the analysis-by-synthesis system 200 described above with reference to FIG. 2. When the analysis unit 204 samples analog sound waves 100 at a medium or low bit rate, the coded speech that is produced by the synthesis unit 220 and output by speaker 222 does not sound natural. FIG. 3 illustrates an example of the synthesized speech signal 300 that is output by the synthesis unit 220 to the speaker 222. The synthesized speech signal 300 includes background noise 302 along with speech groups 304–308. Notice that within synthesized speech 300 there is attenuated background noise 302 produced within the speech groups 304–308. The reason for this phenomenon is the fact that the analysis unit coder 204 is specifically tailored to model the speech groups 104–108 of FIG. 1 of the analog sound waves 100 and fails to adequately reproduce the background noise 102 existing within the speech groups 104–108. Therefore, when the synthesized speech signal 300 is output by speaker 222, it sounds unnatural to the human ear because of the abrupt changes in the amplitude of the background noise 302 which occur at the beginning and end of the speech groups 304–308.

Therefore, given a speech signal that is coded at a medium to low bit rate by an analysis unit of an analysis-by-synthesis system for coding and decoding speech, it would be advantageous to provide a system that enables a synthesis unit to output synthesized speech signals that sound natural and realistic to the human ear. The present invention provides this advantage.

SUMMARY OF THE INVENTION

The present invention includes a system and method to improve the quality of coded speech coexisting with background noise. For instance, the present invention receives a coded speech signal via a communication network and then decodes and synthesizes the different parameters contained within it to produce a synthesized speech signal. The present invention determines the non-speech periods that are represented within the synthesized speech signal. The determined non-speech periods are then utilized to inject simulated background noise into the output signal. Furthermore, the non-speech periods are also used by the present invention to determine when to combine the simulated background noise with the speech periods of the synthesized speech signal. The resulting output signal of the present invention is an improved synthesized speech signal that sounds more natural and realistic to the human ear because of the continuous presence of background noise, as opposed to the background noise substantially existing in between the speech periods.

A method for improving the quality of coded speech coexisting with background noise, the method comprising the steps of: (a) producing a synthesized speech signal having a synthesized voice portion and a synthesized background noise portion, the synthesized speech signal based on a received coded speech signal comprising linear prediction coefficients, pitch coefficients, an excitation code word, and energy (gain); (b) producing a background noise signal using a subset of the linear prediction coefficients and energy extracted from the coded speech signal corresponding to the synthesized background noise portion of the synthesized speech signal; (c) combining the background noise signal and the synthesized speech signal to produce a natural sounding output synthesized speech signal.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

In the following detailed description of the present invention, a system and method to improve the quality of coded speech coexisting with background noise, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1:
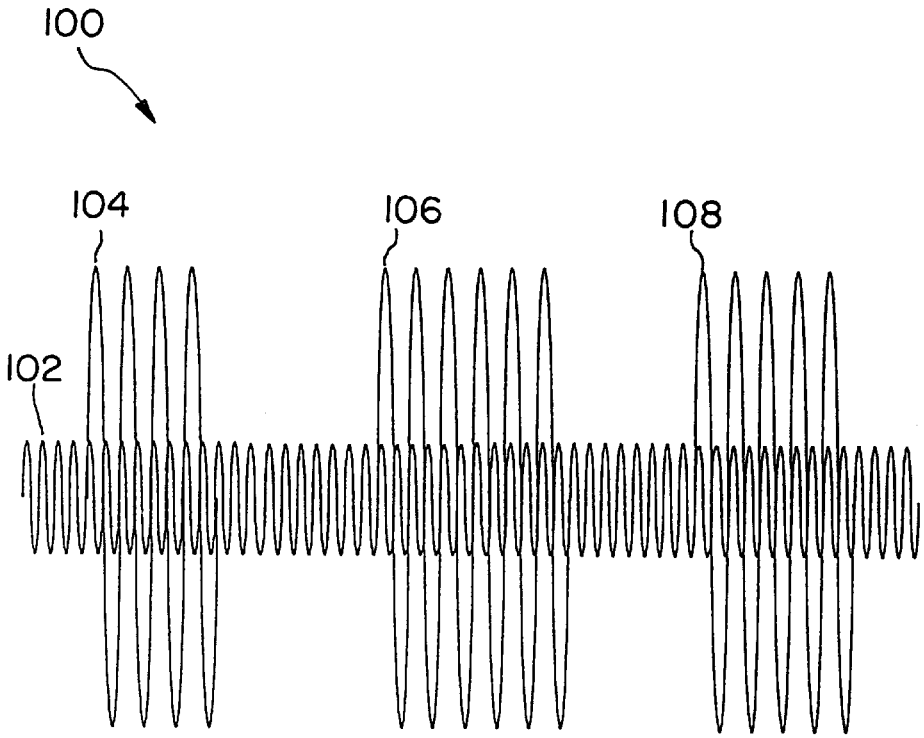
FIG. 1 PRIOR ART
FIG. 1 illustrates the analog sound waves of a typical speech conversation which includes background or ambient noise throughout the signal.
Figure 3:
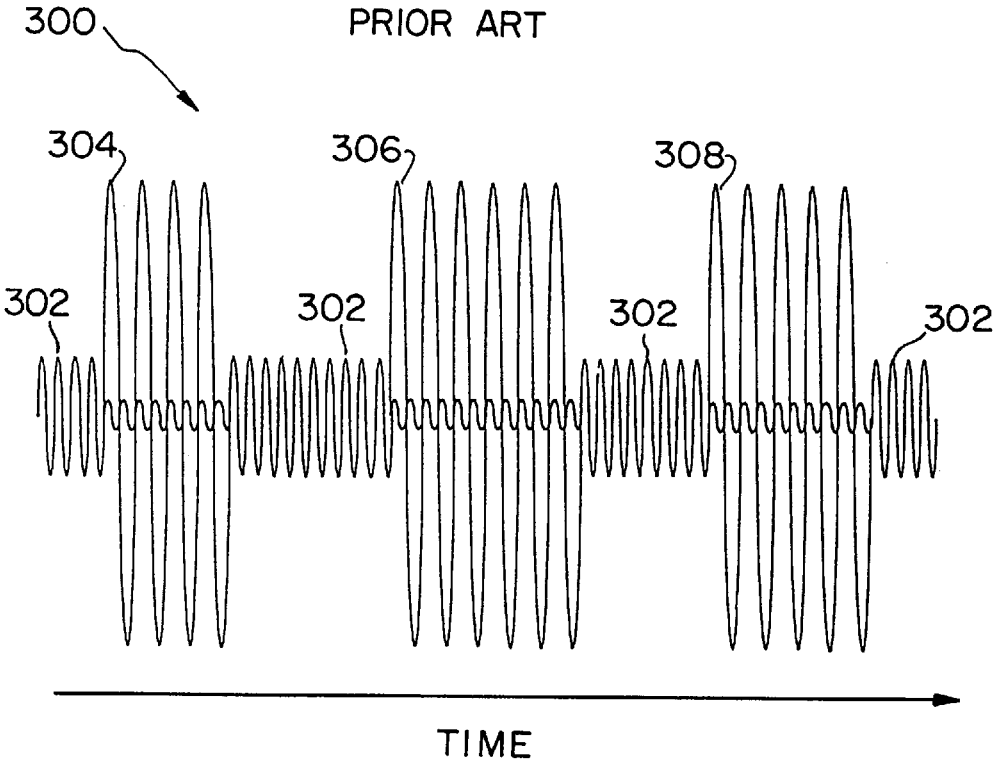
FIG. 3 PRIOR ART
FIG. 3 illustrates the synthesized speech signal that is output by a synthesis unit in accordance with the prior art system.
Figure 2:
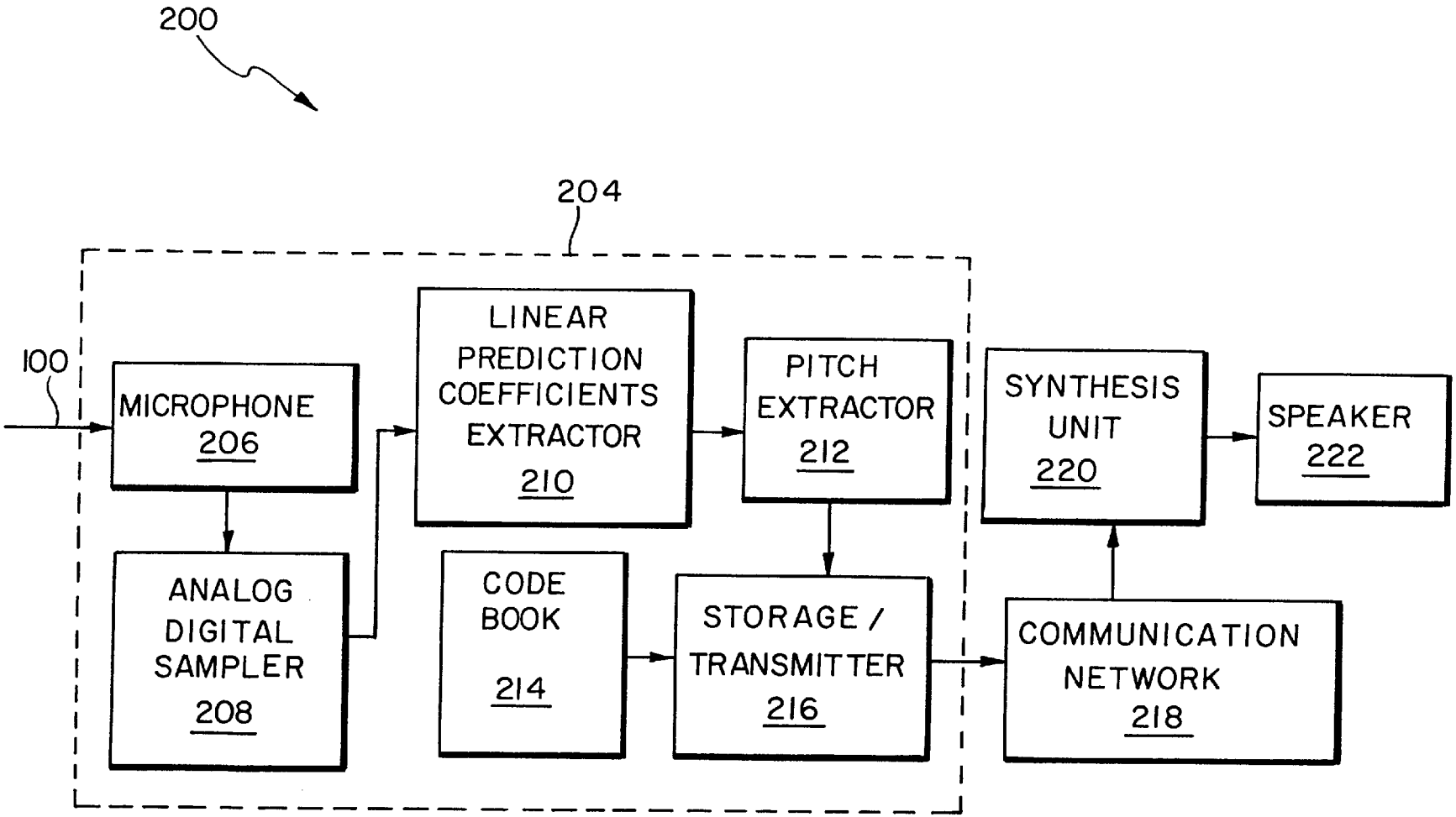
FIG. 2 PRIOR ART
FIG. 2 illustrates a general overview block diagram of a prior art analysis-by-synthesis system for coding and decoding speech.
Figure 4:
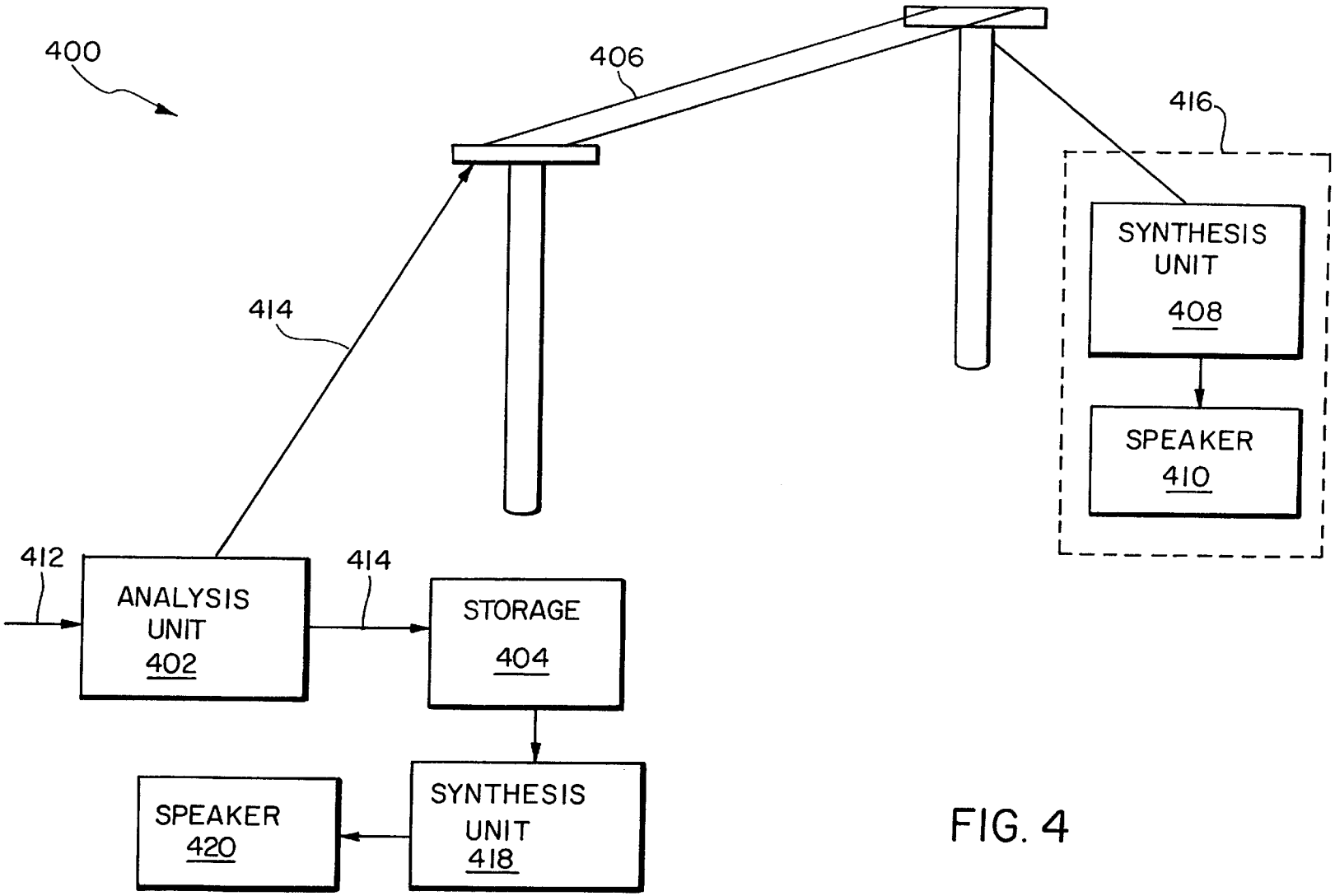
FIG. 4 illustrates a general overview of the analysis-by-synthesis system for coding and decoding speech in which the present invention operates.

The present invention operates within the field of coded speech communication. Specifically, FIG. 4 illustrates a general overview of the analysis-by-synthesis system 400 used for coding and decoding speech for communication and storage in which the present invention operates. The analysis unit 402 receives conversation signal 412, which is a signal composed of representations of voice communication along with background noise. One embodiment of the analysis unit 402 within the present invention has the same electrical components and operations as the analysis unit 204 of FIG. 2 previously described. The analysis unit 402 encodes the conversation signal 412 into a digital (compressed) coded speech signal 414 that includes voice portions and background noise portions. After coding the received conversation signal 412, the analysis unit 402 can either transmit coded speech signal 414 to a receiver device 416 (e.g., telephone or cell phone) via communication network 406 or to a storage device 404 (e.g., magnetic or optical recording device or answering machine).

Receiver device 416 of FIG. 4 transfers the coded speech signal 414 to the synthesis unit 408 when its received via communication network 406. The synthesis unit 408 produces a synthesized speech signal that is represented by the received coded speech signal 414. Additionally, in accordance with the present invention, the synthesis unit 408 utilizes the received background noise represented within the received coded speech signal 414 to produce simulated background noise which is properly combined with the synthesized speech signal. The resulting output signal from the synthesis unit 408 is an improved synthesized speech signal that has a continuous level of background noise in between and during the speech periods of the signal. The speaker 410 outputs the improved synthesized speech signal received from the synthesis unit 408, which sounds more realistic and natural to the human ear because the background noise is continuous, as oppose to the background noise substantially existing in between speech periods.

The storage device 404 of FIG. 4 is optionally connected to one of the outputs of the analysis unit 402 in order to provide storage capability to store any coded speech signals 414, which can later be played back at some desired time. One embodiment of the storage device 404 in accordance with the present invention is a random access memory (RAM) unit, a floppy diskette, a hard drive memory unit, or a digital answering machine memory. When the stored coded speech signal 414 is played back at a later time, it is first output from storage device 404 to a synthesis unit 418. Synthesis unit 418 performs the same functions as synthesis unit 408 described above. The resulting output signal from synthesis unit 418 is an improved synthesized speech signal that has a continuous level of background noise in between and during the speech periods of the signal. Speaker 420 outputs the improved synthesized speech signal received from synthesis unit 408, which sounds more realistic and natural to the human ear.

Figure 5:
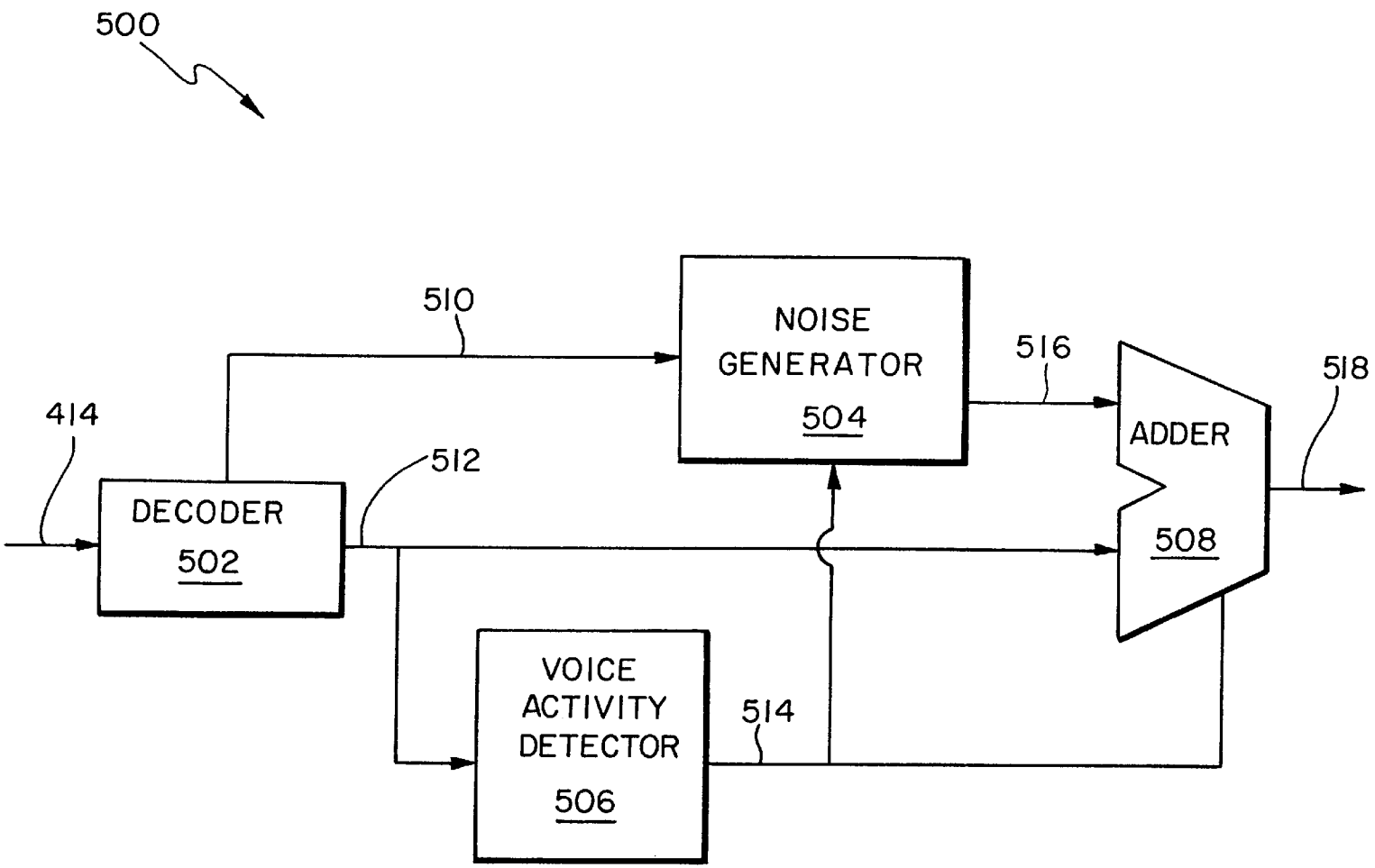
FIG. 5 illustrates a block diagram of one embodiment of a synthesis unit in accordance with an embodiment of the present invention located within the analysis-by-synthesis system of FIG. 4.

FIG. 5 illustrates a block diagram of synthesis circuit 500, which is one embodiment of the synthesis unit 408 of FIG. 4 in accordance with an embodiment of the present invention. The decoder circuit 502 of the synthesis circuit 500 is the component that receives the coded speech signal 414 via the communication network 406. The decoder circuit 502 then decodes and synthesizes the different parameters received within the coded speech signal 414, which represent the voice communication 412. The speech signal 414 includes coded linear prediction coefficients (LPC), pitch coefficients, fixed excitation code words, and energy. It should be appreciated that gain factors can be derived from the energy contained within the coded speech signal 414. The decoder circuit 502 transmits a signal 510 containing both the linear prediction coefficients and the energy to the noise generator circuit 504. Furthermore, the decoder circuit 502 transmits a synthesized speech signal 512 to both the adder circuit 508 and the voice activity detector (VAD) circuit 506. The synthesized speech signal 512 includes synthesized voice portions and synthesized background noise portions. One embodiment of the decoder circuit 502 in accordance with the present invention is implemented with software.

The noise generator circuit 504 of FIG. 5 utilizes a subset of the energy and a subset of the linear prediction coefficients of signal 510 to produce a simulated background noise signal 516, which is transmitted to the adder circuit 508. The adder circuit 508 adds the simulated background noise signal 516 to the synthesized voice portions of the synthesized speech signal 512 in order to make the output signal 518 sound more natural to the human ear. Furthermore, the adder circuit 508 passes through to its output the synthesized background noise portions or the non-speech portions of the synthesized speech signal 516, which become part of the natural sounding output synthesized speech signal 518. The adder circuit 508 differentiates which function it is performing based on the receipt of signal 514, which is transmitted by the voice activity detector circuit 506 discussed below. In accordance with the present invention, the noise generator circuit 504 and the adder circuit 508 can also be implemented with software.

The voice activity detector circuit 506 of FIG. 5 distinguishes the synthesized non-speech periods (e.g., periods of only synthesized background noise) contained within the received synthesized speech signal 512 from the synthesized speech periods. Once the voice activity detector circuit 506 determines the non-speech periods of the synthesized speech signal 512, it transmits an indication to both the noise generator circuit 504 and the adder circuit 508 as signal 514. The noise generator circuit 504 utilizes the signal 514 to aid it in the production of the simulated background noise signal 516. One embodiment of the voice activity detector circuit 506 in accordance with the present invention is implemented with software.

The receipt of signal 514 of FIG. 5 by the adder circuit 508 governs the particular function it performs to produce the natural sounding output synthesized speech signal 518. Specifically, the non-speech periods contained within signal 514 indicates to the adder circuit 508 when to allow the synthesized non-speech periods contained within the received synthesized speech signal 512 to pass through to its output. Furthermore, the speech periods contained within signal 514 indicate to the adder circuit 508 when to add the received simulated background noise signal 516 and the synthesized voice periods contained within the received synthesized speech signal 512.

Figure 6:
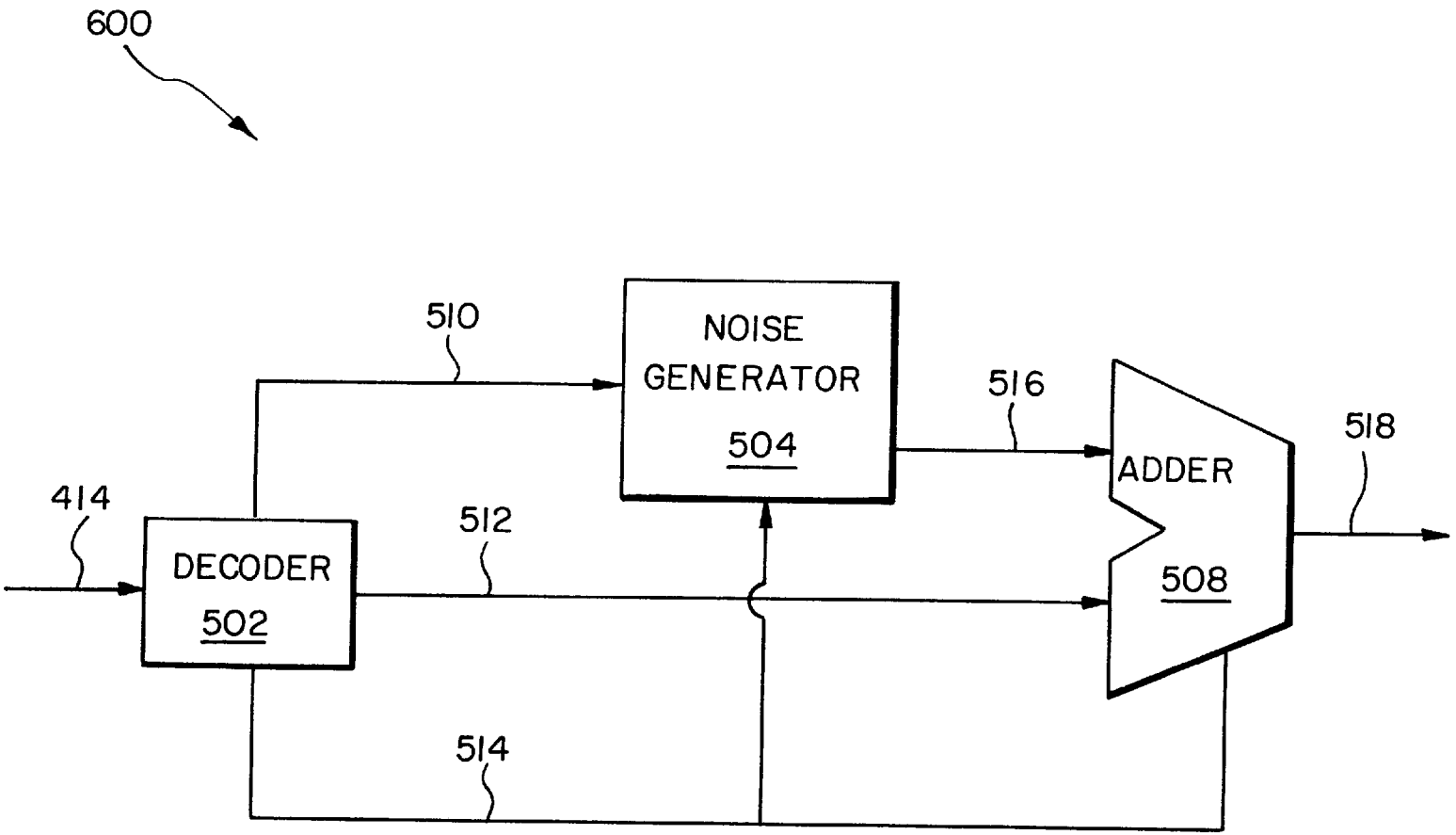
FIG. 6 illustrates a block diagram of another embodiment of a synthesis unit in accordance with an embodiment of the present invention located within the analysis-by-synthesis system of FIG. 4.

FIG. 6 illustrates a block diagram of synthesis circuit 600, which is another embodiment of the synthesis unit 408 of FIG. 4 in accordance with an embodiment of the present invention. The synthesis circuit 600 is analogous to the synthesis circuit 500 of FIG. 5, except that it does not contain the voice activity detector circuit 506. The decoder circuit 502, the noise generator circuit 504 and the adder circuit 508 each perform generally the same functions as described above with reference to FIG. 5. The only component within synthesis circuit 600 that does perform an addition function is the decoder circuit 502. In order for the decoder circuit 502 to produce signal 514, which indicates the non-speech periods of synthesized speech signal 512, the analysis unit 402 of FIG. 4 also contains a voice activity detector circuit that performs the same function as the voice activity detector circuit 506 of FIG. 5. The non-speech period data determined by the voice activity detector circuit located within the analysis unit 402 is then included within the coded speech signal 414.

Figure 7:
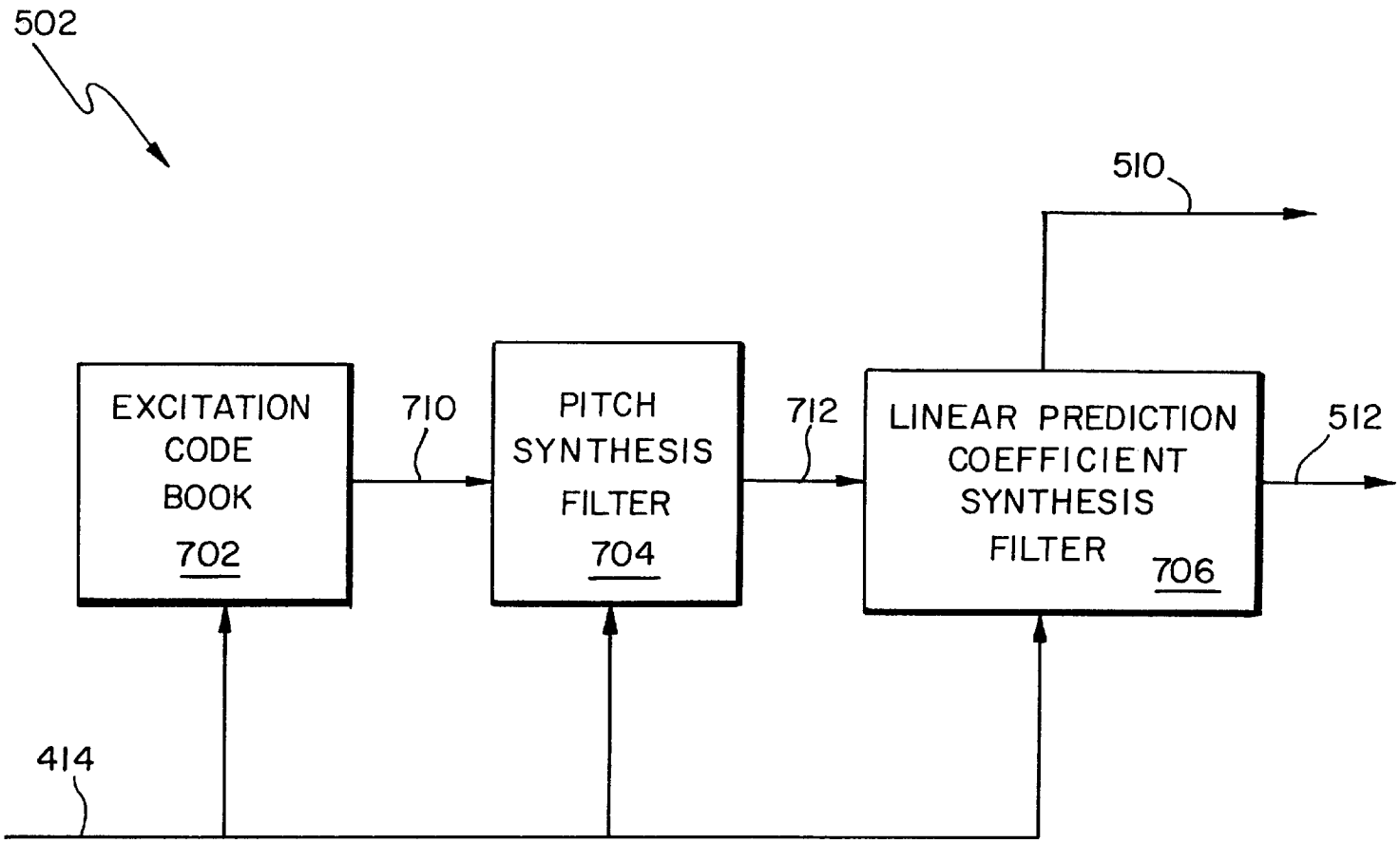
FIG. 7 illustrates a block diagram of one embodiment of a decoder circuit in accordance with an embodiment of the present invention located within the synthesis unit of FIGS. 5 and 6.

FIG. 7 illustrates a block diagram of one embodiment of the decoder circuit 502 in accordance with an embodiment of the present invention located within FIGS. 5 and 6. The excitation code book circuit 702, the pitch synthesis filter circuit 704 and the linear prediction coefficient synthesis filter circuit 706 each receive the coded speech signal 414, which was transferred via the communication network 406 of FIG. 4. The excitation code book circuit 702 receives a fixed excitation code word and produces the corresponding digital signal pattern multiplied by its gain value as signal 710, which was represented within the received coded speech signal 414. The excitation code book circuit 702 then transmits signal 710 to the pitch synthesis filter circuit 704. One embodiment of the excitation code book circuit 702 in accordance with the present invention is implemented with software.

The pitch synthesis filter circuit 704 of FIG. 7 receives the encoded pitch coefficients contained within coded speech signal 414 and produces the corresponding decoded pitch signal, which it combines with the received signal 710 in order to produce output signal 712. The linear prediction coefficient synthesis filter circuit 706 receives the encoded linear prediction coefficients, contained within coded speech signal 414, which are "synthesized" and then added to signal 712 in order to produce a synthesized speech signal 512. The linear prediction coefficient synthesis filter circuit 706 also outputs the signal 510 containing the energy and the linear prediction coefficients to the noise generator circuit 504 of FIGS. 5 and 6. In accordance with the present invention, the pitch synthesis filter circuit 704 and the linear prediction coefficient synthesis filter circuit 706 can also be implemented with software.

Figure 8:
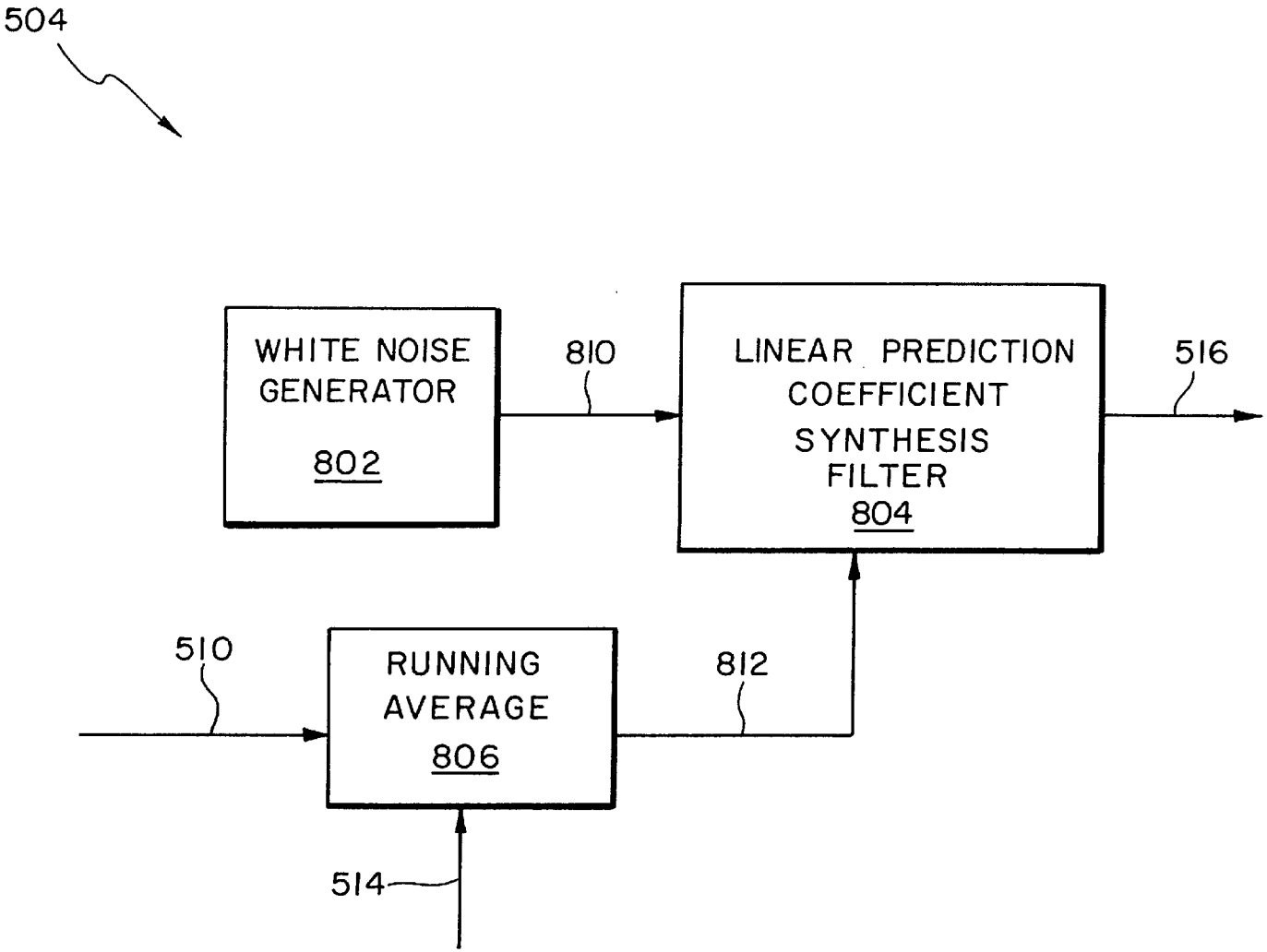
FIG. 8 illustrates a block diagram of one embodiment of a noise generator circuit in accordance with an embodiment of the present invention located within the synthesis unit of FIGS. 5 and 6.

FIG. 8 illustrates a block diagram of one embodiment of a noise generator circuit 504 in accordance with an embodiment of the present invention located within FIGS. 5 and 6. The running average circuit 806 is the component that receives both the non-speech signal 514 from the voice activity detector 506 of FIG. 5 and the signal 510, containing the energy and the linear prediction coefficients, from the linear prediction coefficient synthesis filter circuit 706 of FIG. 7. The signal 514 indicates to the running average circuit 806 the non-speech periods (e.g., periods of only synthesized background noise) that exist within the energy and the linear prediction coefficients of signal 510. The running average circuit 806 then determines a running average value of the received linear prediction coefficients corresponding to the background noise periods that are represented within signal 510. Furthermore, the running average circuit 806 also determines a running average value of the energy corresponding to the background noise periods that are represented within signal 510. Therefore, the running average circuit 806 continuously stores the determined running average value of the linear prediction coefficients and the determined running average of the energy which correspond to the synthesized background noise of the non-speech periods. The running average circuit 806 then outputs to the linear prediction coefficient synthesis filter circuit 804 a copy of both stored running average values as signal 812.

In another embodiment, the running average circuit 806 of FIG. 8 can also be located within the linear prediction coefficient synthesis filter circuit 706 of FIG. 7. Furthermore, in another embodiment, the running average circuit 806 can be partially located within the linear prediction coefficient synthesis filter circuit 706 while the remaining circuitry is located within the noise generator circuit 504 of FIG. 8. Specifically, the circuitry of the running average circuit 806 that determines the running average values of the linear prediction coefficients and the energy of the background noise is located within the linear prediction coefficient synthesis filter circuit 706, while the storage circuitry of the running average circuit 806 is located within the noise generator circuit 504. One embodiment of the running average circuit 806 in accordance with the present invention is implemented with software.

A white noise generator circuit 802 of FIG. 8 produces a white Gaussian noise signal 810 that is output to linear prediction coefficient synthesis filter circuit 804. One embodiment of the white noise generator circuit 802 in accordance with the present invention is a random number generator circuit. Another embodiment of the white noise generator circuit 802 in accordance with the present invention is implemented with software. The linear prediction coefficient synthesis filter circuit 804 uses the received signals 810 and 812 to produce a simulated background noise signal 516, which is output to adder circuit 508 of FIGS. 5 or 6. One embodiment of the linear prediction coefficient synthesis filter circuit 804 in accordance with the present invention is implemented with software.

Figure 9:
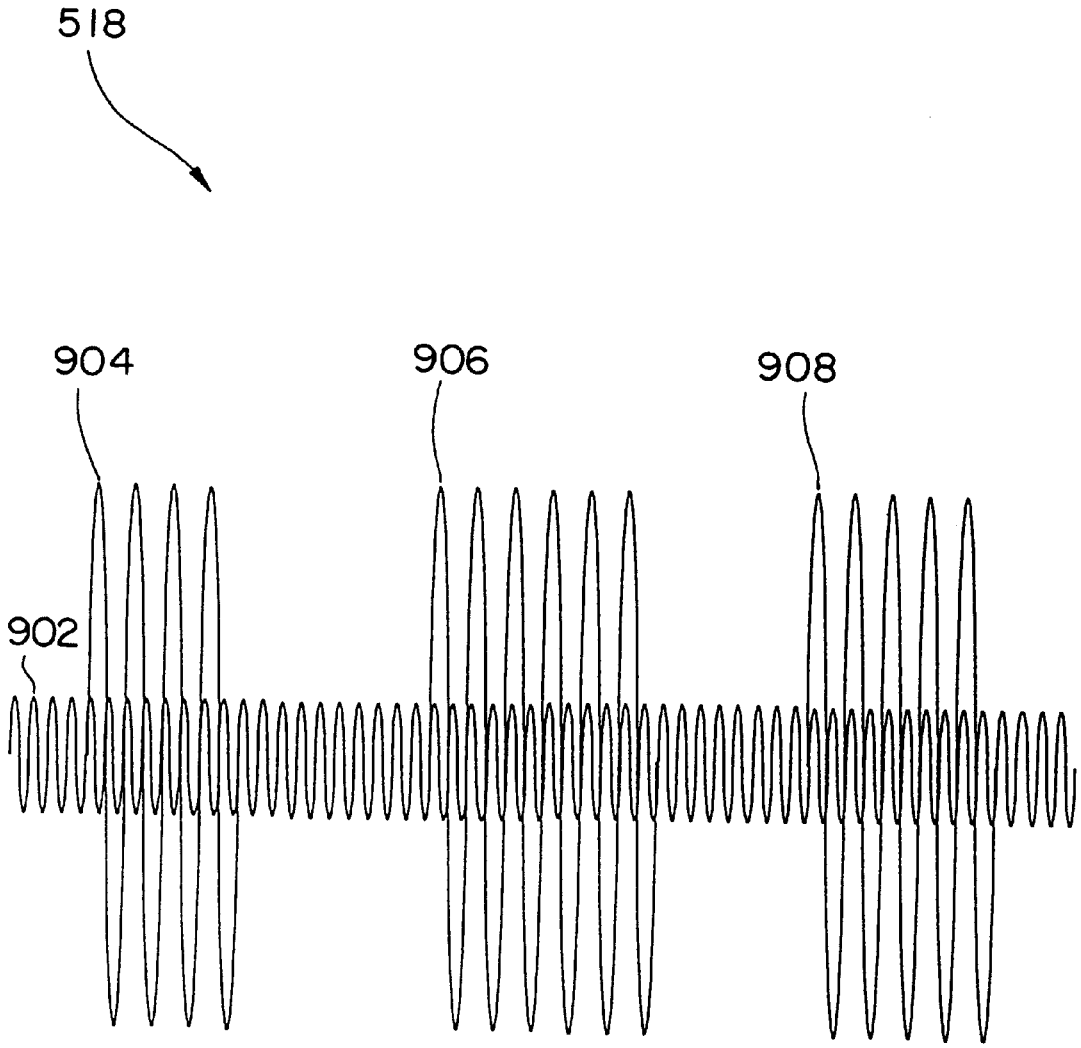
FIG. 9 illustrates the more natural sounding synthesized speech signal that is output by a synthesis unit in accordance with an embodiment of the present invention.

FIG. 9 illustrates the more natural sounding synthesized speech signal 518 that is output by the synthesis circuits 500 and 600 of FIGS. 5 and 6, respectively, in accordance with an embodiment of the present invention. The natural sounding output synthesized speech signal 518 includes background noise 902 and synthesized speech groups 904–908. Notice that background noise 902 is continuously present between and during the synthesized speech groups 904–908. By having the present invention combine simulated background noise with the synthesized speech groups 904–908, the improved synthesized speech signal 518 sounds natural and realistic to the human ear.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method for improving the quality of a synthesized speech signal, comprising the steps of:

(a) producing the synthesized speech signal from a coded speech signal having a background noise portion and a voice portion, the coded speech signal comprising linear prediction coefficients, pitch coefficients, excitation code words, and energy;

(b) determining portions of the synthesized speech signal corresponding to the background noise portion and voice portion of the coded speech signal;

(c) producing a background noise signal using a subset of the linear prediction coefficients and the energy corresponding to the background noise portion of the coded speech signal;

(d) adding the background noise signal to the synthesized speech signal corresponding to the voice portion of the coded speech signal whereby the added background noise produces a more natural sounding output synthesized speech signal.

2. The method of claim 1 further comprising the steps of determining running average values of the subset of the linear prediction coefficients and the energy corresponding to the background noise portion of the coded speech signal and producing the background noise signals using the running average values.

3. The method of claim 2 further comprising the step of adding a white noise signal to the synthesized speech signal corresponding to the voice portion of the coded speech signal.

4. The method of claim 3 wherein the white noise signal is produced by a random number generator circuit.

5. A method for improving the quality of a synthesized speech signal, comprising the steps of:

(a) producing the synthesized speech signal from a coded speech signal comprising linear prediction coefficients, pitch coefficients, excitation code words, and energy;

(b) producing a background noise signal using a subset of the linear prediction coefficients and the energy of the coded speech signal;

(c) determining speech periods and non-speech periods of the synthesized speech signal;

(d) adding the background noise signal to the synthesized speech signal during the speech periods of the synthesized speech signal whereby the added background noise produces a more natural sounding output synthesized speech signal.

6. The method of claim 1 wherein the coded speech signal comprises a voice portion and a background noise portion.

7. The method of claim 6 further comprising the steps of producing the background noise signal using a subset of the linear prediction coefficients and the energy corresponding to the background noise portion of the coded speech signal and adding the background noise signal to the synthesized speech signal corresponding to the voice portion of the coded speech signal.

8. The method of claim 6 further comprising the steps of determining running average values of the subset of the linear prediction coefficients and the energy corresponding to the background noise portion of the coded speech signal and producing the background noise signal using the running average values.

9. The method of claim 8 further comprising the step of adding a white noise signal to the synthesized speech signal during the speech periods of the synthesized speech signal.

10. The method of claim 9 wherein the white noise signal is produced by a random number generator circuit.

11. A synthesis unit for improving the quality of a synthesized speech signal comprising:

a decoder circuit for generating a synthesized speech signal from a received coded speech signal having a background noise portion and voice portion, the coded speech signal comprising linear prediction coefficients, pitch coefficients, excitation words, and energy a noise generator circuit coupled to the decoder circuit for generating a background noise signal using a subset of the linear prediction coefficients and the energy corresponding to the background noise portion of the coded speech signal, and an adder coupled to the decoder circuit and the noise generator circuit for adding the background noise signal to the synthesized speech signal corresponding to the voice portion of the coded speech signal to produce a more natural sounding output synthesized speech signal.

12. The noise generator circuit of claim 11 further comprising a running average circuit for determining running average values of the subset of the linear prediction coefficients and the energy corresponding to the background noise portion of the coded speech signal.

13. The noise generator circuit of claim 12 further comprising a white noise generator circuit for producing a white noise signal, wherein the white nose signal is used to produce the background signal.

14. The synthesis unit of claim 13 wherein the white noise generator circuit is a random number generator circuit.

15. The noise generator circuit of claim 13 further comprising a first linear prediction coefficient synthesis filter circuit coupled to the running average circuit and the white noise generator circuit for producing the background noise signal using the running average values and the white noise signal.

16. The decoder circuit of claim 15 further comprising:

an excitation code book circuit for producing a digital signal pattern from the excitation code words of the coded speech signal to partially synthesize the synthesized speech signal;

a pitch synthesis filter circuit for partially synthesizing the synthesized speech signal using the pitch coefficients; and a second linear prediction coefficient synthesis filter circuit for partially synthesizing the synthesized speech signal using the linear prediction coefficients and the energy.

17. The synthesis unit of claim 11 further comprising a voice activity detector circuit coupled to the decoder circuit for determining speech and non-speech periods of the synthesized speech signal and outputting a signal to the adder indicating the speech and non-speech periods of the synthesized speech signal, wherein the adder adds the background noise signal to the synthesized speech signal when the detector output signal indicates the speech periods of the synthesized speech signal.

18. The synthesis unit of claim 17 wherein the adder does not add the background noise signal to the synthesized speech signal when the detector output signal indicates the non-speech periods of the synthesized speech signal.

19. The synthesis unit of claim 18 wherein the background noise is added to the synthesized speech signal to reduce the difference between the background noise of the speech and non-speech periods of the synthesized speech signal.

* * * * *